US008610360B2

(12) United States Patent
Hsu et al.

(10) Patent No.: US 8,610,360 B2
(45) Date of Patent: Dec. 17, 2013

(54) LED DEVICE AND METHOD FOR PREVENTING SOFT-START FLICKER

(75) Inventors: Kuo-Ching Hsu, Hsinchu (TW); Chin-Hsun Hsu, Taipei County (TW); Tsung-Hau Chang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 252 days.

(21) Appl. No.: 12/629,893

(22) Filed: Dec. 3, 2009

(65) Prior Publication Data

US 2011/0001434 A1 Jan. 6, 2011

(30) Foreign Application Priority Data

Jul. 6, 2009 (TW) ..... 98122743 A

(51) Int. Cl.
*H05B 37/00* (2006.01)

(52) U.S. Cl.
USPC ..... 315/186; 315/192; 315/307; 315/360

(58) Field of Classification Search
USPC ..... 315/360, 185 R, 186, 192, 291, 294, 315/297, 299, 300, 306, 307, 312
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 7,804,256 | B2 * | 9/2010 | Melanson | 315/291 |
| 7,868,602 | B2 * | 1/2011 | Omi et al. | 323/284 |
| 7,884,558 | B2 * | 2/2011 | Steele et al. | 315/312 |
| 7,906,917 | B2 * | 3/2011 | Tripathi et al. | 315/291 |
| 7,973,487 | B2 * | 7/2011 | Vaucourt et al. | 315/224 |
| 8,461,769 | B2 * | 6/2013 | Shiu et al. | 315/291 |
| 2006/0273331 | A1 * | 12/2006 | Lim et al. | 257/80 |
| 2006/0279228 | A1 * | 12/2006 | Kato | 315/193 |
| 2007/0127276 | A1 * | 6/2007 | Yoshimatsu et al. | 363/49 |
| 2009/0195168 | A1 * | 8/2009 | Greenfeld | 315/192 |
| 2010/0220049 | A1 * | 9/2010 | Murakami | 345/102 |

FOREIGN PATENT DOCUMENTS

| | | |
|---|---|---|
| CN | 1897780 A | 1/2007 |
| TW | 200607393 | 2/2006 |
| TW | 200615731 | 5/2006 |
| TW | 200705789 | 2/2007 |

* cited by examiner

*Primary Examiner* — Tung X Le
(74) *Attorney, Agent, or Firm* — Winston Hsu; Scott Margo

(57) ABSTRACT

A light-emitting diode (LED) device for preventing soft-start flicker includes an LED module, a voltage converter, a variable current load and a loop control unit. The loop control unit is coupled to the LED module, the voltage converter and the variable current load, and includes a soft-start unit and a dimming control unit. The soft-start unit is utilized for activating a soft-start mechanism of the voltage converter when power of the LED device is turned on. The dimming control unit is utilized for controlling the variable current load to progressively increase a load current of the LED module to a target value and to maintain the load current on the target value until the soft-start mechanism is completed, so as to perform dimming control on the LED module.

15 Claims, 6 Drawing Sheets

LED DEVICE AND METHOD FOR PREVENTING SOFT-START FLICKER

BACKGROUND OF THE INVENTION

1. Field of the Invention

The present invention relates to a light-emitting diode (LED) device and related method for preventing soft-start flicker, and more particularly, to an LED device and related method using a progressively increased load current to perform dimming during a soft-start operation.

2. Description of the Prior Art

Light emitting diodes (LEDs) used as light sources have become popular in recent years. For example, the light source in a back light module of a conventional liquid crystal display (LCD) panel is usually a plurality of cold cathode fluorescent lamps (CCFLs). However, as the luminous efficiency increases and the cost decreases, LEDs have gradually replaced CCFLs to be the light source in a back light module.

In the prior art, an LED driving circuit usually uses pulse width modulation (PWM) mechanism to adjust the brightness of the LED. The PWM dimming primarily takes advantage of a PWM signal to control an average current provided by a current source for the LEDs. When the PWM signal is logical high, the current source is conducted to provide a current for the LED. On the contrary, when the PWM signal is logical low, the current source is stopped providing the current for the LED. Therefore, if the PWM signal stays at logical high longer, the LED gets brighter. In other words, the brightness of the LED can be controlled by changing a duty cycle of the PWM signal.

Please refer to FIG. 1, which is a schematic diagram of an LED driving circuit 10 according to the prior art. The LED driving circuit 10 is utilized for driving an LED module 11. As shown in FIG. 1, the LED module 11 includes parallel-connected LED strings C1~Cm. Each of the LED strings is composed of multiple LEDs connected in series. The LED driving circuit 10 includes a voltage converter 12, a current load 13, a dimming switch 15 and a loop control unit 14. The voltage converter 12 is utilized for converting an input voltage V1 into an output voltage V2 to drive the LED module 11. The current load 13 is utilized for sinking constant currents Id1~Idm from the LED module 11. The dimming switch 15 is utilized for conducting or closing couplings between the current load 13 and each of the LED strings C1~Cm to control the average current of the LEDs. The loop control unit 14 is utilized for controlling the voltage converter 12 to convert voltages according to a voltage difference between the feedback voltage of the LED strings C1~Cm and a predetermined reference voltage to regulate the voltage level of the output voltage V2. Besides, the loop control unit 14 further includes a dimming control unit 142 for generating a PWM signal SD to implement the dimming procedure.

On the other hand, since the feedback voltages of the LED strings C1~Cm increase from zero progressively when the system power is on, it is quite different than the predetermined reference voltage of the loop control unit 14. This situation allows the output voltage V2 to go rapidly from logical low to the desired voltage level but the voltage converter 12 may generate a large surge and overshoot during power-on. In this situation, the loop control unit 14 usually includes a soft-start unit 144 to reduce the voltage difference between the predetermined reference voltage and the feedback voltages during power-on, so as to enhance the system stability at start-up time.

However, when the soft-start and PWM dimming both are ongoing, since the current path between the LED module 11 and the current load 13 is conducted and closed alternately but the voltage converter 12 converts voltage only when the current path is conducted, this causes a long soft-start time. In the prior art, the soft-start and PWM dimming are performed separately in different stages. Namely, no PWM dimming is performed during the soft-start operation (the PWM dimming has 100% duty cycle). It is not until the soft-start is completed that the PWM dimming is performed. Such that the long soft-start time can be avoided. However, from no dimming to dimming (e.g. the duty cycle is from 100% to 50%), there may exist a current spike in the average current of the LED, causing soft-start flicker. The more duty cycle has changed from no dimming to dimming, the more the average current of the LED varies. As a result, the soft-start flicker gets more severe at the transient.

SUMMARY OF THE INVENTION

It is thereof an objective of the present invention to provide an LED device and related method for preventing soft-start flicker.

The present invention discloses an LED device for preventing soft-start flicker. The LED device includes an LED module, a voltage converter, a variable current load, and a loop control unit. The voltage converter is coupled to the LED module, and utilized for converting a first voltage into a second voltage to output the second voltage to the LED module. The variable current load is coupled to the LED module, and utilized for sinking load current from the LED module. The loop control unit is coupled to the LED module, the voltage converter and the variable current load. The loop control unit includes a soft-start unit and a dimming control unit. The soft-start unit is utilized for activating a soft-start mechanism of the voltage converter when power of the LED device is turned on. The dimming control unit is utilized for controlling the variable current load to progressively increase the load current to a target value and to maintain the load current on the target value until the soft-start mechanism is completed.

The present invention further discloses a method of preventing an LED device from soft-start flicker. The LED device includes an LED module, a voltage converter for converting a first voltage into a second voltage to output the second voltage to the LED module, and a variable current load for sinking load current from the LED module. The method includes the steps of activating a soft-start mechanism of the voltage converter when power of the LED device is turned on, progressively increasing the load current to a target value to perform dimming on the LED module and maintaining the load current on the target value until the soft-start mechanism is completed when the load current reaches the target value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
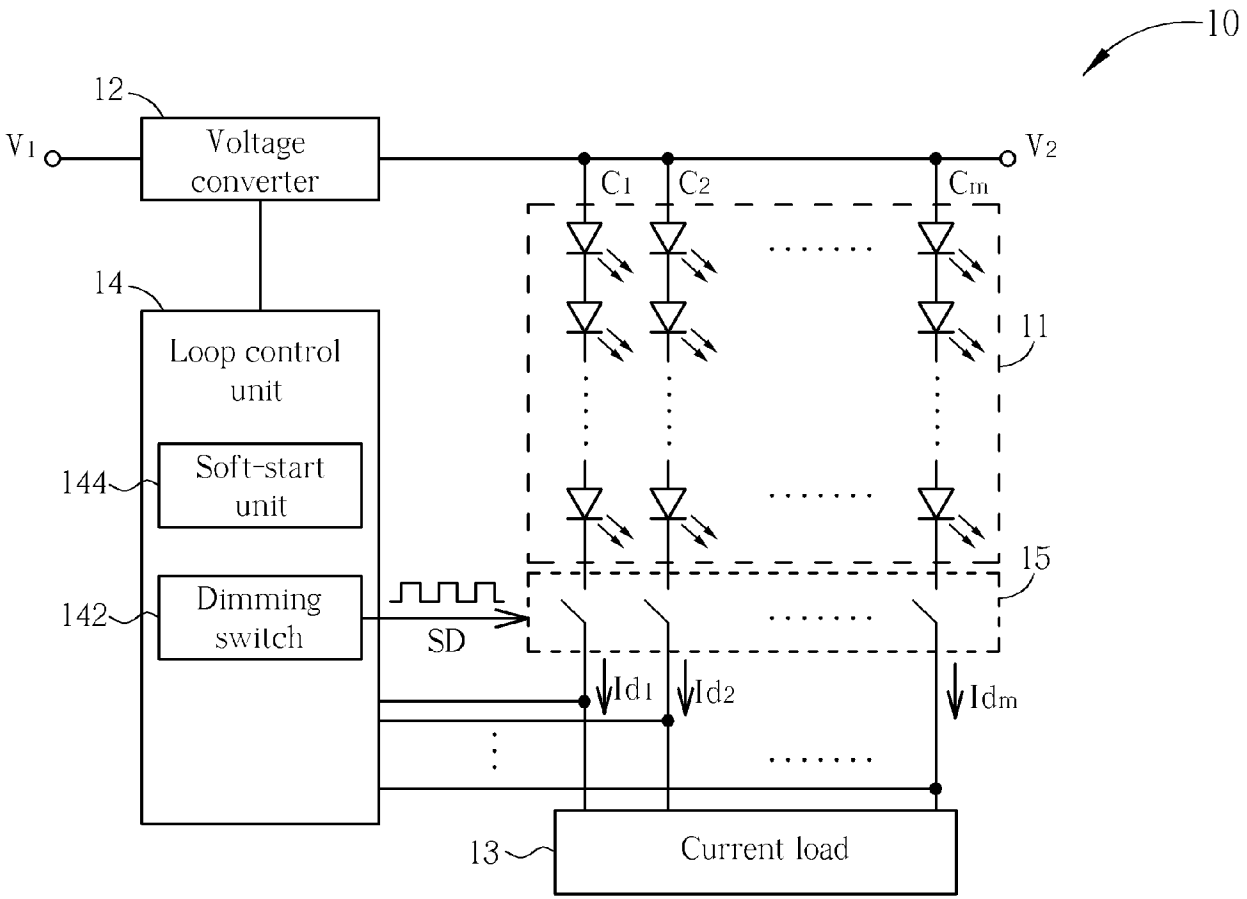
FIG. 1 PRIOR ART
FIG. 1 is a schematic diagram of an LED driving circuit according to the prior art.
Figure 2:
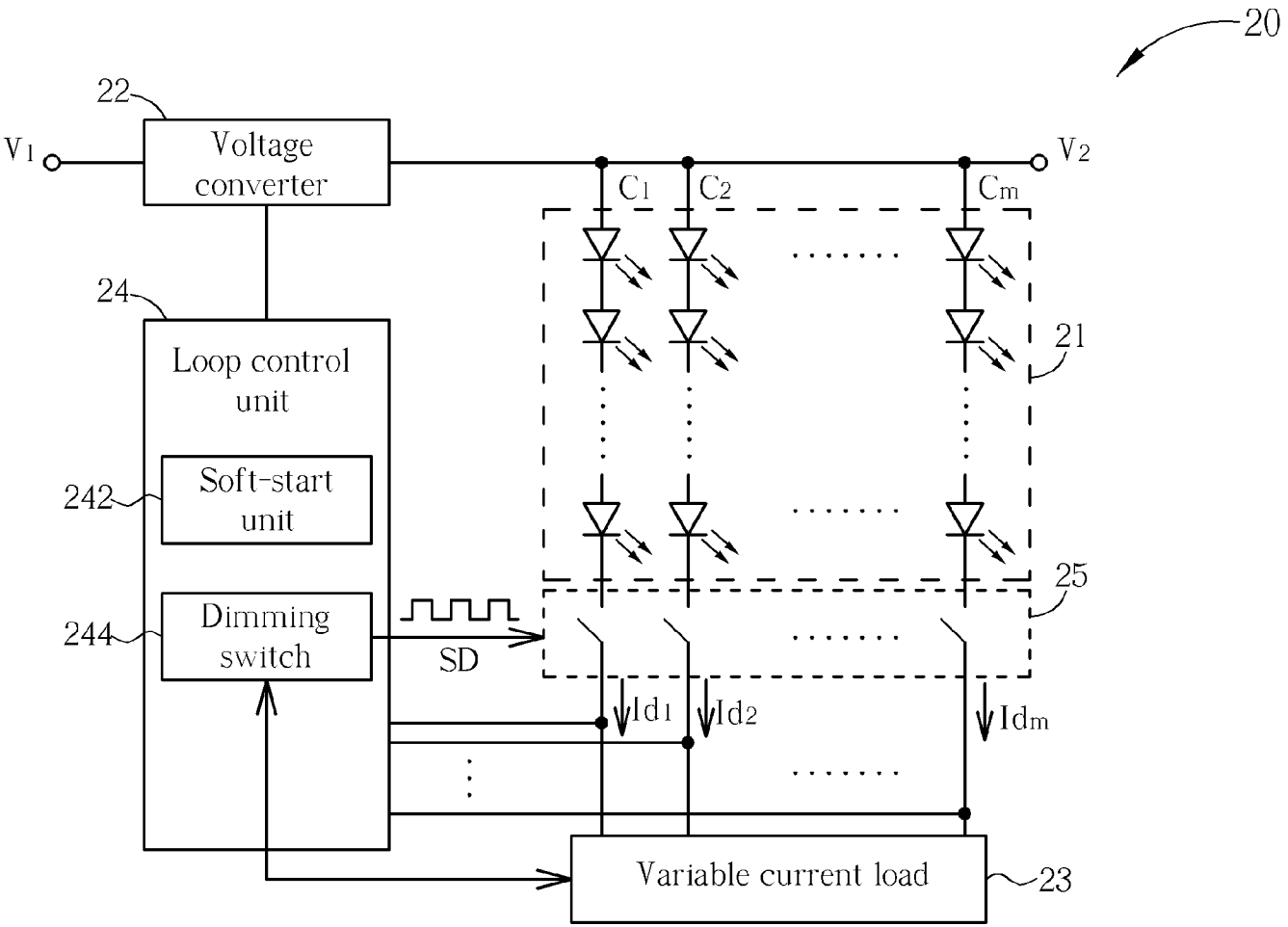
FIG. 2 is a schematic diagram of an LED device of preventing soft-start flicker according to an embodiment of the present invention.

Please refer to FIG. 2, which is a schematic diagram of an LED device 20 capable of preventing soft-start flicker according to an embodiment of the present invention. The LED device 20 includes an LED module 21, a voltage converter 22, a variable current load 23, and a loop control unit 24. In the embodiment of the present invention, the LED module 21 includes LED strings C1~Cm in parallel. Each of the LED strings is composed of multiple LEDs connected in series, but not restricted herein. In other words, the LED module 21 can have one LED string only or each of the LED strings has only one LED. Since the LED is a current driving component with the brightness corresponding to the driving current, for the same brightness, the number of the LEDs included in each LED string must be the same in order to allow the current through each LED to be identical.

The voltage converter 22 is coupled to the LED module 21 and utilized for converting a first voltage V1 into a second voltage V2 as a stable driving voltage for the LED module 21. The variable current load 23 is coupled to the other end of the LED module 21 and utilized for sinking the load currents Id1~Idm from the LED module 21. The loop control unit 24 is coupled to the voltage converter 22, the variable current load 23 and the LED module 21, and utilized for controlling the voltage converter 22 to perform voltage conversion according to the difference between a predetermined reference voltage and the feedback voltage of the LED strings C1~Cm to regulate the voltage level of the output voltage V2. The loop control unit 24 further includes a soft-start unit 242 and a dimming control unit 244. The soft-start unit 242 is utilized for activating a soft-start mechanism of the voltage converter 22 when power of the LED device 20 is turned on. The dimming control unit 244 is utilized for controlling the variable current load 23 to progressively increase the load currents Id1~Idm to a target value and to maintain the load currents Id1~Idm on the target value until the soft-start mechanism is completed.

When the soft-start mechanism is complete, the dimming control unit 244 can further use pulse width modulation (PWM) mechanism, namely, generating a PWM signal SD to perform dimming on the LED module 21. In this situation, the LED device 20 includes a dimming switch 25. The dimming switch 25 is utilized for conducting or closing a current path between the variable current load 23 and the LED strings C1~Cm according to the PWM signal SD generated by the dimming control unit 244, to control the average current of the LEDs and perform the dimming procedure.

Thus, the LED device 20 of the present invention progressively increases the load currents to perform dimming during the soft-start. After the soft-start mechanism is complete, the present invention switches to the conventional PWM mechanism to execute the dimming procedure of the LED module 21. As a result, the embodiment of the present invention improves the soft-start flicker caused by no dimming performed during the soft-start, as well as avoids the long soft-start time caused by the PWM dimming. Regarding the detailed operations of the LED device 20, please refer to the following statements.

Figure 3:
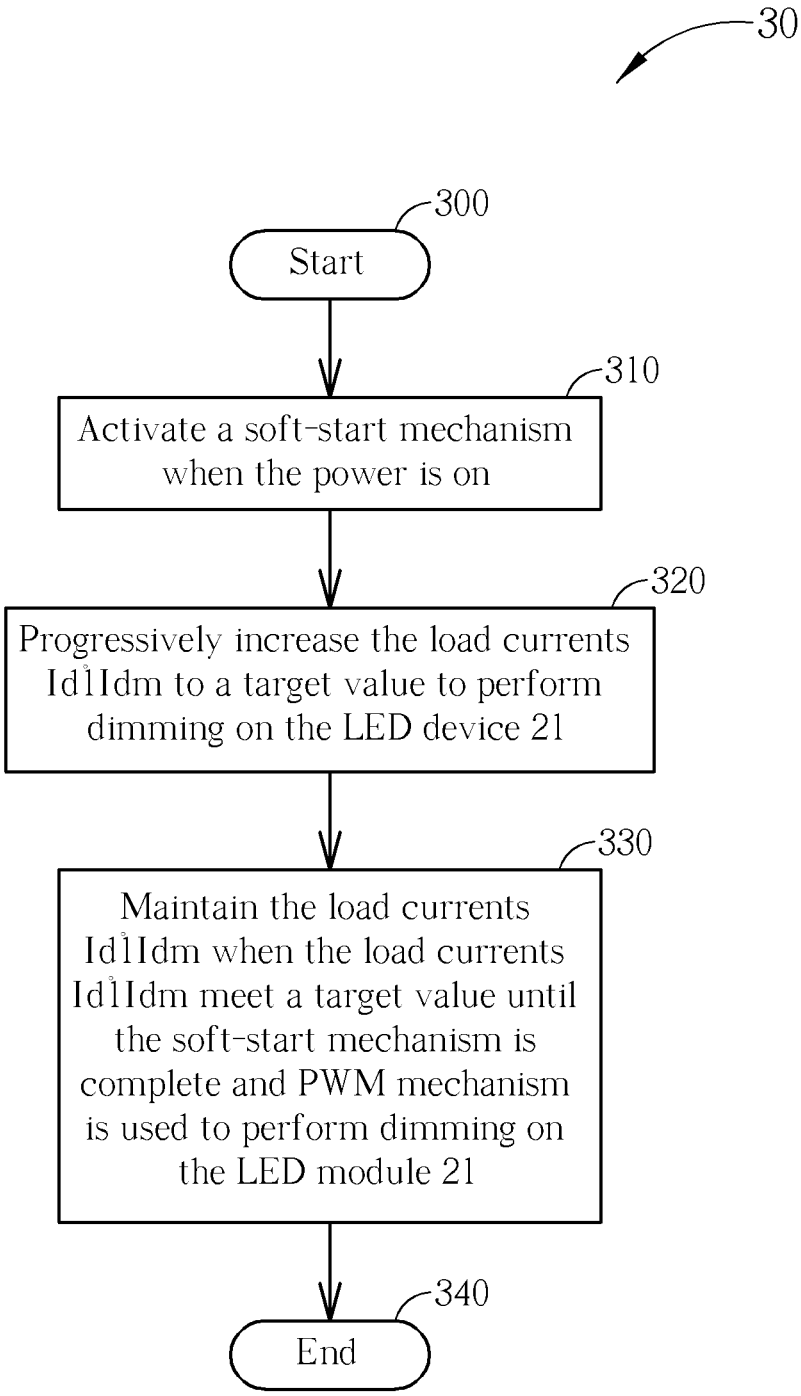
FIG. 3 is a flowchart of a process for preventing an LED device from soft-start flicker according to an embodiment of the present invention.

Please refer to FIG. 3, which is a flowchart of a process 30 for preventing an LED device from soft-start flicker according to an embodiment of the present invention. The process 30 is utilized for implementing an operational process of the LED device 20 and includes the following steps:

Step 300: Start.

Step 310: Activate a soft-start mechanism when the power is on.

Step 320: Progressively increase the load currents Id1~Idm to a target value to perform dimming on the LED device 21.

Step 330: Maintain the load currents Id1~Idm when the load currents Id1~Idm meet a target value until the soft-start mechanism is complete and PWM mechanism is used to perform dimming on the LED module 21.

Step 340: End.

According to the process 30, the LED device 20 activates the soft-Start mechanism of the voltage converter 22 when the power is on. Then, the dimming control unit 244 controls the variable current load 23 to progressively increase the load currents Id1~Idm to the target value for performing dimming on the LED model. When the load currents Id1~Idm meet the target value, the dimming control 244 maintains the load currents Id1~Idm on the target value until the completion of the soft-start mechanism is detected and the PWM mechanism is used for performing dimming on the LED module 21.

Therefore, compared with the prior art, the embodiment of the present invention performs dimming during the soft-start by progressively increasing the load currents rather than using the PWM mechanism, to avoid the long soft-start time caused by that the PWM dimming keeps breaking the voltage convert loop.

On the other hand, since the load currents Id1~Idm increase with time, the current spike caused by the soft-start can be dramatically reduced. Thus, the LED flicker can be improved. In addition, even though the PWM dimming is used after the soft-start mechanism is completed, the average current of the LED will not vary tremendously. This can further avoid the soft-start flicker in the prior art.

Preferably, in the embodiment of the present invention, the process 30 further includes the step of determining if it is necessary for the LED device 20 to perform dimming during the soft-start when the soft-start mechanism is activated. If the LED device 20 must perform dimming during the soft-start, then Steps 320~330 are executed until the soft-start mechanism is completed and the PWM dimming mode is entered. On the contrary, if it is not necessary for the LED device 20 to perform dimming during the soft-start, then Steps 320 and 330 are skipped, and the PWM dimming mode is directly entered with the duty cycle of the PWM dimming set to 100%.

Figure 4:
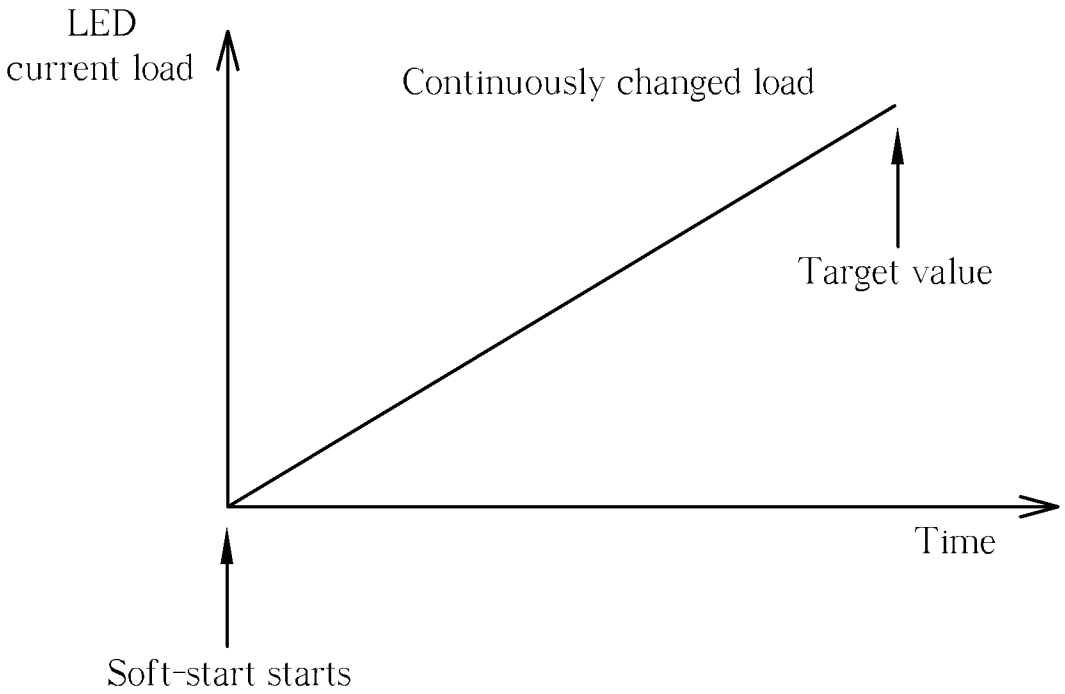
FIG. 4 illustrates a continuously changed load, wherein the load current varies continuously with time.
Figure 5:
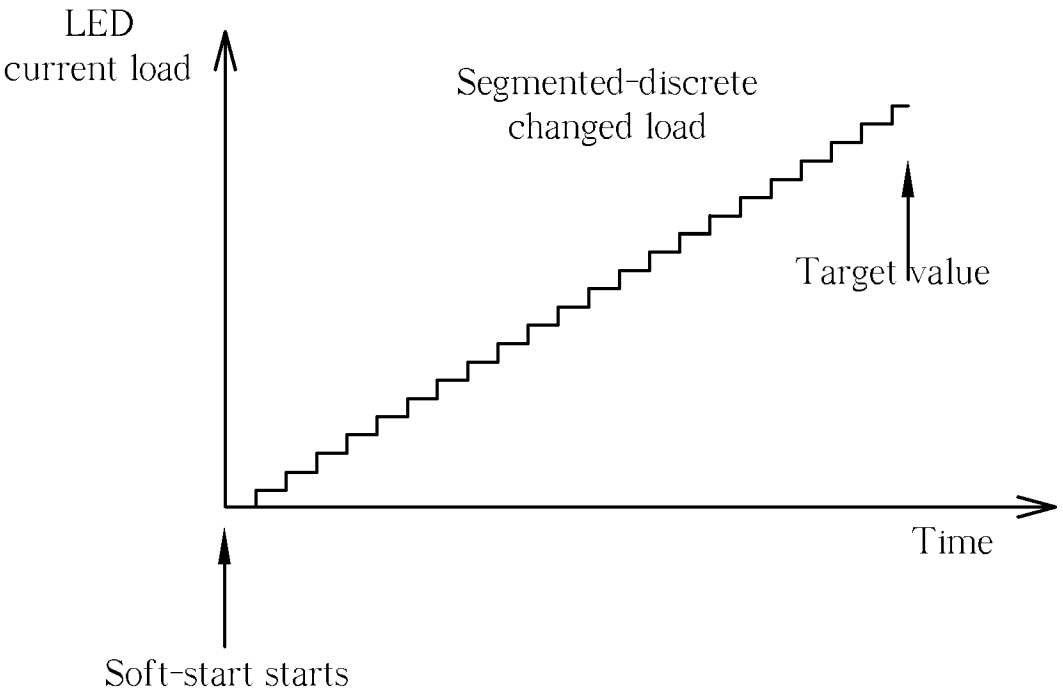
FIG. 5 illustrates a segmented-discrete changed load, wherein the load current varies discretely with time.

In the embodiment of the present invention, the variable current load 23 can be implemented by (1) continuously changed load, by which the load current varies continuously with time as shown in FIG. 4; (2) segmented-discrete changed load, by which the load current varies discretely with time. More segments and smaller variation in each segment mitigates the variation in the load current and the LED flicker as shown in FIG. 5.

Figure 6:
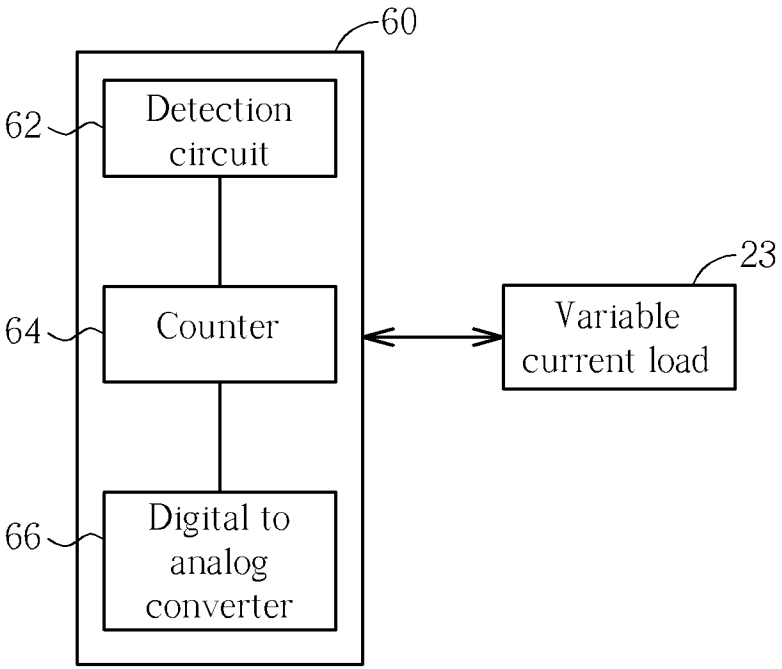
FIG. 6 is a schematic diagram of a dimming control device according to an embodiment of the present invention.

Please continue to refer to FIG. 6, which is a schematic diagram of a dimming control unit 60 according to an embodiment of the present invention. The dimming control 60 is used for implementing the dimming control unit 244 mentioned above and includes a detection circuit 62, a counter 64 and a digital to analog converter (DAC) 66. The detection circuit 62 is utilized for detecting whether the soft-start mechanism is activated or not, and triggering the counter 64 when the soft-start mechanism is activated. The DAC 66 outputs an analog signal to the variable current load 23 to progressively increase the load currents of the LED module until the load currents meet the target value.

To sum up, the embodiment of the present invention improves the long soft-start time by progressively increasing the load currents instead of using the PWM dimming. Besides, even if the embodiment of the present invention uses the PWM dimming after the soft-start is completed, the average current of the LED does not have tremendously variation, such that the soft-start flicker can be further avoided.

Those skilled in the art will readily observe that numerous modifications and alterations of the device and method may be made while retaining the teachings of the invention.

What is claimed is:

1. A light-emitting diode (LED) device for preventing soft-start flicker, the LED device comprising:

an LED module;

a voltage converter coupled to the LED module, for converting a first voltage into a second voltage to output the second voltage to the LED module;

a variable current load coupled to the LED module, for sinking a load current from the LED module; and a loop control unit coupled to the LED module, the voltage converter and the variable current load, the loop control unit comprising:

a soft-start unit for activating a soft-start mechanism of the voltage converter when power of the LED device is turned on; and a dimming control unit for controlling the variable current load to progressively increase the load current to a target value and to maintain the load current on the target value until the soft-start mechanism is completed;

wherein the load current does not return to zero before the soft-start mechanism is completed, and the second voltage is fixed.

2. The LED device of claim 1 further comprising:

a dimming switch coupled to the LED module, the variable current load and the dimming control unit, for conducting or closing a current path between the variable current load and the LED module according to a pulse width modulation (PWM) signal generated by the dimming control unit.

3. The LED device of claim 1, wherein the dimming control unit uses a PWM mechanism to perform dimming on the LED module when the soft-start mechanism is completed.

4. The LED device of claim 1, wherein the dimming control unit further determines whether dimming is performed on the LED device during operation of the soft-start mechanism when the soft-start mechanism is activated.

5. The LED device of claim 1, wherein the variable current load progressively increases the load current to the target value by continuously changing load.

6. The LED device of claim 1, wherein the variable current load progressively increases the load current to the target value by segmented-discrete changing load.

7. The LED device of claim 1, wherein brightness of the LED module corresponds to magnitude of the load current.

8. The LED device of claim 1, wherein the LED module comprises a plurality of LED strings.

9. A method of preventing a light-emitting diode (LED) device from soft-start flicker, the LED device comprising an LED module, a voltage converter for converting a first voltage into a second voltage to output the second voltage to the LED module, and a variable current load for sinking a load current from the LED module, the method comprising the steps of:

activating a soft-start mechanism of the voltage converter when power of the LED device is turned on;

controlling a variable current load to progressively increase the load current to a target value to perform dimming on the LED module; and maintaining the load current on the target value until the soft-start mechanism is completed when the load current meets the target value;

wherein the load current does not return to zero before the soft-start mechanism is completed, and the second voltage is fixed.

10. The method of claim 9 further comprising the step of:

using a pulse width modulation (PWM) mechanism to perform dimming on the LED module when the soft-start mechanism is completed.

11. The method of claim 9 further comprising the step of:

determining whether dimming is performed during operation of the soft-start mechanism when the soft-start mechanism is activated.

12. The method of claim 9, wherein the step of progressively increasing the load current to the target value comprises progressively increasing the load current to the target value by continuously changing load.

13. The method of claim 9, wherein the step of progressively increasing the load current to the target value comprises progressively increasing the load current to the target value by segmented-discrete changing load.

14. The method of claim 9, wherein brightness of the LED module corresponds to magnitude of the load current.

15. The LED device of claim 9, wherein the LED module comprises a plurality of LED strings.

* * * * *